United States Patent [19]

Thabet

[11] 4,310,992

[45] Jan. 19, 1982

[54] STRUCTURAL PANEL

[75] Inventor: Pierre J. Thabet, Beauce, Canada

[73] Assignee: Construction Murox, Inc., Quebec, Canada

[21] Appl. No.: 123,072

[22] Filed: Feb. 20, 1980

[30] Foreign Application Priority Data

Sep. 20, 1979 [CA] Canada ..... 336016

[51] Int. Cl.[3] ..... E04C 2/26; E04C 2/08; E04B 1/76

[52] U.S. Cl. ..... 52/309.11; 52/262; 52/282; 52/283; 52/293; 52/465; 52/469; 52/582; 52/584; 52/807

[58] Field of Search ..... 52/309.11, 282, 293, 52/461, 465, 469, 584, 582, 90, 580, 806, 807, 283, 262

[56] References Cited

U.S. PATENT DOCUMENTS

| | | | |
|---|---|---|---|
| 1,561,573 | 11/1925 | Smith . | |
| 1,693,742 | 12/1928 | Bemis . | |
| 1,858,701 | 5/1932 | Boettcher | 52/293 X |
| 2,051,707 | 8/1936 | Harrison | 52/469 X |
| 2,113,875 | 4/1938 | Clark . | |
| 2,116,557 | 5/1938 | Billner . | |
| 2,226,248 | 12/1940 | Lunken . | |
| 2,270,218 | 1/1942 | Palmer | 52/469 |
| 2,370,638 | 3/1945 | Crowe . | |
| 2,457,982 | 1/1949 | Derchmann . | |
| 2,616,283 | 11/1952 | Branstrator et al. | 52/408 |
| 2,680,503 | 6/1954 | Clarke | 52/469 |
| 3,353,315 | 11/1967 | Barker . | |
| 3,363,383 | 1/1968 | La Barge | 52/584 X |
| 3,531,901 | 10/1970 | Will, Jr. et al. . | |
| 3,562,985 | 2/1971 | Nicosia . | |
| 3,623,288 | 11/1971 | Horowitz | 52/293 |
| 3,632,149 | 1/1972 | Konig | 52/282 X |
| 3,676,973 | 7/1972 | Kellert . | |
| 3,678,638 | 7/1972 | Mougin . | |
| 3,713,261 | 1/1973 | Landis | 52/580 X |
| 3,755,982 | 9/1973 | Schmidt . | |
| 3,772,842 | 11/1973 | Barbera . | |
| 3,828,502 | 8/1974 | Carlsson . | |
| 3,854,260 | 12/1974 | O'Hanlon | 52/584 |
| 3,969,852 | 7/1976 | Krings . | |
| 3,992,844 | 11/1976 | Gretter . | |
| 4,048,778 | 9/1977 | Krings . | |

FOREIGN PATENT DOCUMENTS

| | | | |
|---|---|---|---|
| 766791 | 10/1971 | Belgium | 52/309.11 |
| 823364 | 9/1969 | Canada . | |
| 893956 | 2/1972 | Canada . | |
| 906176 | 8/1972 | Canada . | |
| 962426 | 2/1975 | Canada . | |
| 970677 | 7/1975 | Canada . | |
| 983231 | 2/1976 | Canada . | |
| 1020325 | 11/1977 | Canada . | |
| 1025623 | 2/1978 | Canada . | |
| 1027330 | 3/1978 | Canada . | |
| 1039919 | 10/1978 | Canada . | |

*Primary Examiner*—Alfred C. Perham
*Attorney, Agent, or Firm*—Cushman, Darby & Cushman

[57] ABSTRACT

A structural building panel comprising interior and exterior skins, the vertical edges of which are connected to pairs of hat shaped cross section vertical members, said vertical members being arranged with the channel portions of the sections facing each other and spaced apart by horizontal girts between said skins joined to the hat shaped vertical members, the space between said skins being filled with insulation.

7 Claims, 6 Drawing Figures

STRUCTURAL PANEL

The present invention relates to a prefabricated building panel, and to buildings constructed utilizing such panels.

Numerous patents have been granted relating to building panel structures, which may be prefabricated in a factory, and then erected together on a building site to form a complete building. Canadian Pat. No. 823,364 issued Sept. 23, 1969 to H. H. Robertson Company; Canadian Pat. No. 906,176 issued Aug. 1, 1972 to Kaiser Aluminum Corporation; Canadian Pat. Nos. 1,039,919 781,010 issued to Immanual M. Glaros and Canadian Pat. No. 962,426 issued Feb. 11, 1975 granted to Allied Steel Products Corporation are Canadian patents illustrative of the prior art in the field of prefabricated building structures.

The present invention provides a significant improvement over the teachings of the above-listed and other prior patents in the field of prefabricated building panels, and in particular provides a prefabricated building panel suitable for use in the Canadian climate, and which may be quickly and easily erected on site in any climate with a minimum of equipment and labor and at a minimum cost. Prefabricated buildings constructed in accordance with the present invention may be provided with a variety of door and window openings to suit the requirements for which the building is to be used, and within the limits of structural strength, buildings of any size and shape may be constructed using the prefabricated building panels of the present invention. A major feature of the present invention is the ease with which the building may be erected. A further feature of the invention is the relative facility for extending buildings constructed in accordance with the present invention.

In accordance with the present invention, one embodiment of a structural building panel comprises an exterior sheet metal skin, an interior sheet metal skin, a pair of hat shaped section uprights at each vertical edge of the panel, with the channel shaped parts of the hat shaped sections facing away from each other, the exterior and interior skins overlying the flat flange on one side of each hat shaped section, a plurality of horizontal girts fastened to the pairs of hat shaped uprights at the vertical edges of the sheets, an insulating strip adhered to the outer face of each girt, the space between the interior and exterior skins being filled with insulation, the skins being fastened to the girts. Plates are fastened to the interior of the lower ends of the pair of hat shaped section uprights to permit a bolt to pass through a hole in the plate to attach the panel to a footing. A compressible plastic frame is affixed to the lower edge of the panel to seal between the panel and the footing.

The panels of the present invention are intended to be prefabricated in a factory, and shipped to the building site on novel shipping jigs or cradles. The cradles protect the panels during transport until the panels are unbolted from the cradles as they are lifted into place during construction of the building.

The panels of the invention are light, strong and well insulated to make a warm and spacious building capable of rapid onsite erection. A prepainted skin is applied over the exterior pair of adjacent top hat sections, and the appearance of a column is enhanced.

A very important aspect of the present invention is the fact that by use of a novel structure of the panel that there is virtually no thermal conductivity through the edges of the panels, and that there is a minimum thermal conductivity between interior and exterior faces. The separate members which make up the columns formed by the edges of two adjacent panels are formed of four separate pieces with no direct thermal connection between interior and exterior panels. In view of this there is no direct path at the columns through which heat losses can occur. The panels themselves are formed of sheet steel interior and exterior walls covering a frame consisting of pairs of hat-shaped cross-section uprights interconnected by horizontal girts. All cavities within the interior of the wall are filled with a foamed in place urethane foam insulation, and the hat section uprights are filled with glass wool. Exterior joints between adjacent panels are insulated, and the horizontal girts are provided with wood faces separating the girts from the exterior panelling. As a further heat loss reduction feature the individual panels are placed on the foundation with a compressible foam along the lower edge of the panel, and with the plate securing the panel to the foundation being attached to the foundation by bolts on the interior only of the building. No bolting is required on the exterior of the building, and there are no direct metalic thermal connections across the thickness of the panels.

The panels can be set in place using a lightweight crane, and can be aligned after erection without necessity to use the crane. Thus the panels can be aligned by workmen after all panels have been set in place.

Panels are shipped to the building set in novel jigs to avoid damage during transit, and facilitate the onsight erection of the building.

It should be noted that no onsight welding is required in order to construct a building in accordance with this invention, the only building trade required is the steel erecting trade, socalled "riggers".

It should be noted that the wall portions of the panels of the invention are not load bearing. Only the column portions made of the top-hat sections are required to carry roof or ceiling loads.

It will be appreciated that in a normal building construction two parallel walls will be the load bearing walls carrying the roof loads and the other two walls of the building placed at right angles are non-bearing. Provision is made in the columns of the load bearing walls for connection to various types of roof joists or truss structures, such provisions being made during construction of the panels.

Building corners are constructed following the teachings of the present application as part of a non-bearing wall rather than as part of the load bearing wall, and as a result give a lot of rigidity to the building. If required, diagonal bracing can be incorporated within the panels, if additional strength to resist horizontal loading is required.

In drawings which illustrate an embodiment of the present invention,

Figure 1:
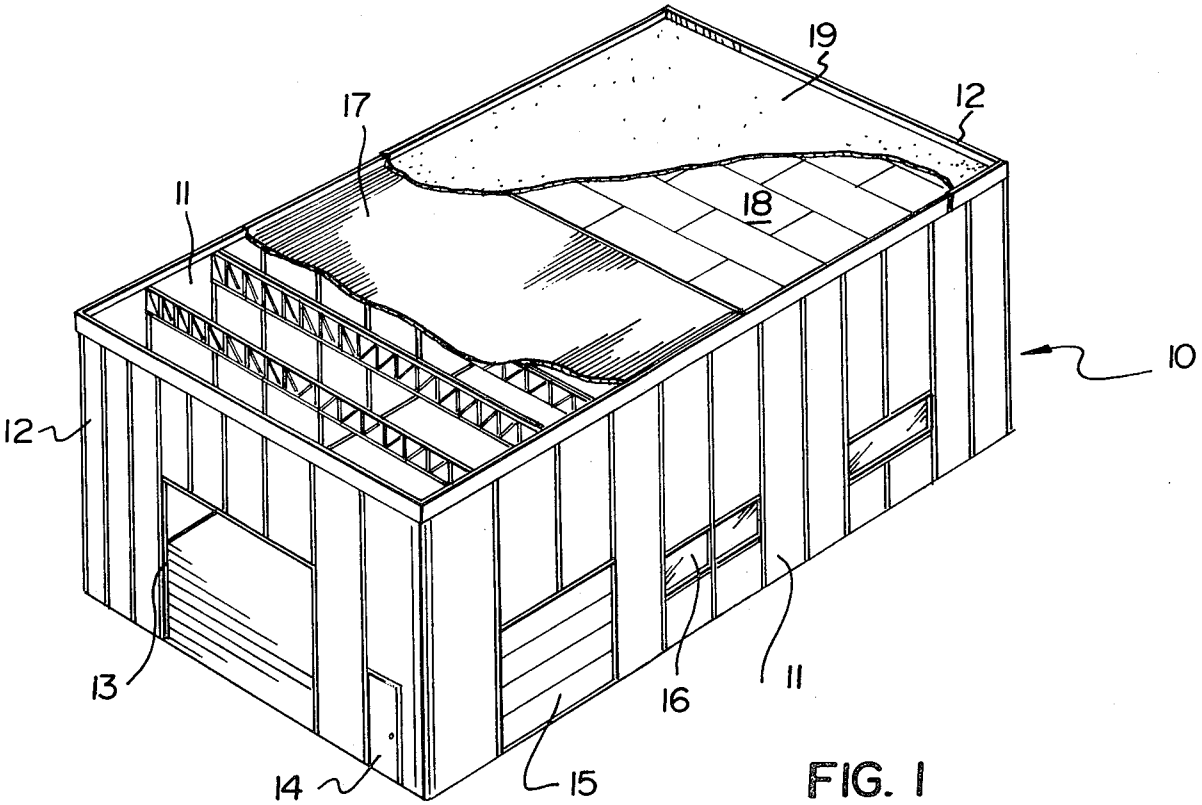
FIG. 1 is a perspective view partly broken away to illustrate a typical building constructed in accordance with the present invention.

Referring to FIG. 1 there is illustrated in perspective a building 10 constructed in accordance with the teachings of the present invention. The building is of rectangular configuration consisting of load bearing walls 11 and non-load bearing walls 12. As illustrated in FIG. 1 a variety of openings are provided in the building which form windows and doors. In one wall 12 there is provided a large shipping type door 13, and a small door 14 for personel access. In one of the walls 11 there is illustrated an overhead roll-up type garage door 15 and a plurality of windows generally indicated at 16. Such openings are of course provided in the prefabricated panels of the invention by variation in the size and shape of panels during manufacture.

As indicated generally in FIG. 1 and as shown in more detail hereafter, adjacent panels when joined together form columns between the edges of the panels which columns are load bearing, and to which roof trusses and the like are connected. Obviously if interior floors are provided in the building, such floor may be hung from the vertical columns in the same fashion as roof trusses. The roof illustrated in FIG. 1 consists of a deck or pan 17 on which is provided an insulating layer 18 of suitable insulating material of an appropriate thickness, and over which is applied a weather-proof roof surface 19 of conventional building construction. Additional details of the roof structure are illustrated in FIG. 3.

Figure 2:
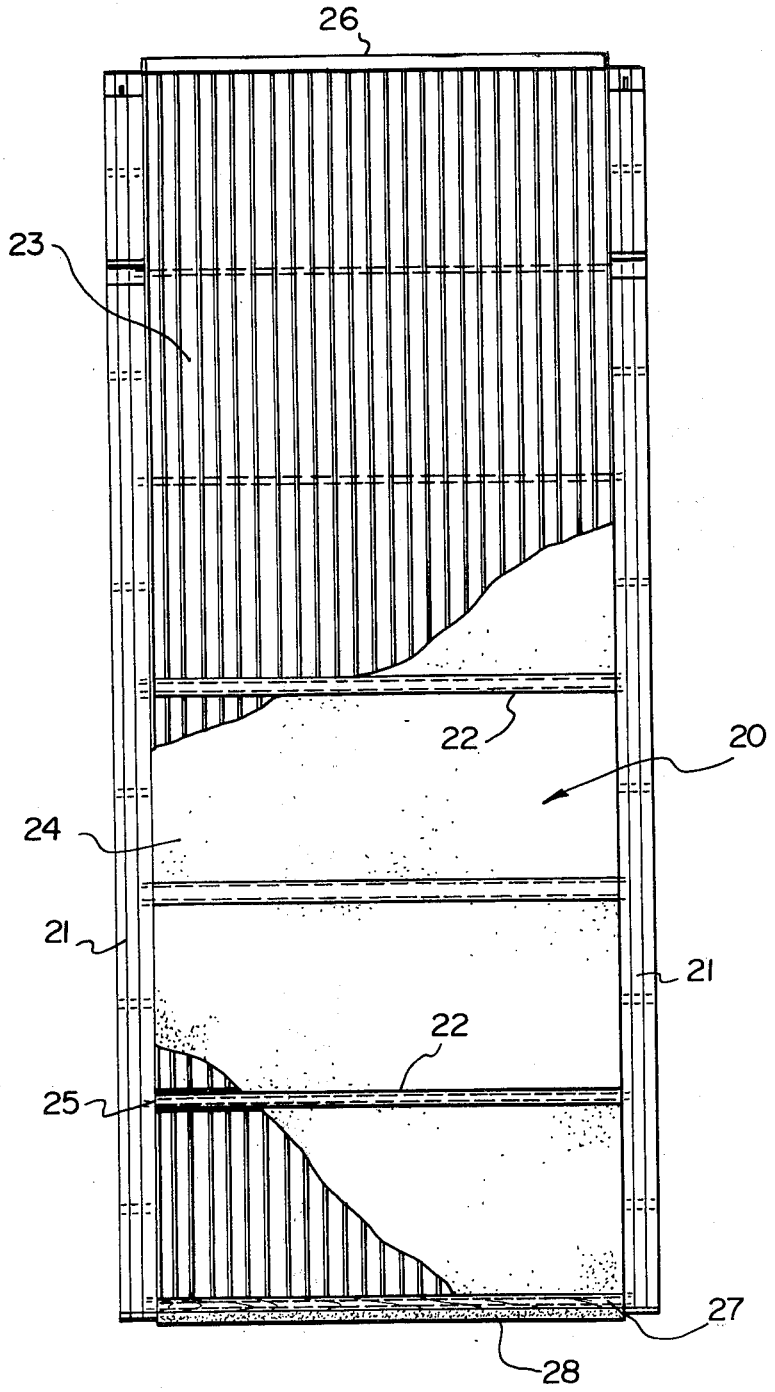
FIG. 2 is an elevation of a panel constructed in accordance with the invention with part of the exterior skin removed to show the interior construction.

An individual panel 20 is illustrated in FIG. 2. The panel comprises pairs of vertically arranged top-hat cross-section column members 21, horizontal girts 22 connected to the column members 21 and an exterior and interior skin, the exterior skin 23 only being illustrated in FIG. 2. The interior of the panel is filled with a foamed in place synthetic insulation such as polyurethane or urea formaldehyde 24, and the outer face of the girts 22 is provided with a wooden strap 25 extending the length of the girt 22 and providing a thermal break between the metalic skin 23 and the girt 22. The upper and lower ends of the panel 20 are closed by wood members 26 and 27 and the member 27 is additionally provided with a compressible foam seal 28 so that when the panel is erected in place the foam is compressed against the foundation and seals any spaces between the panel and the foundation. This is shown in more detail in FIG. 3.

Figure 3:
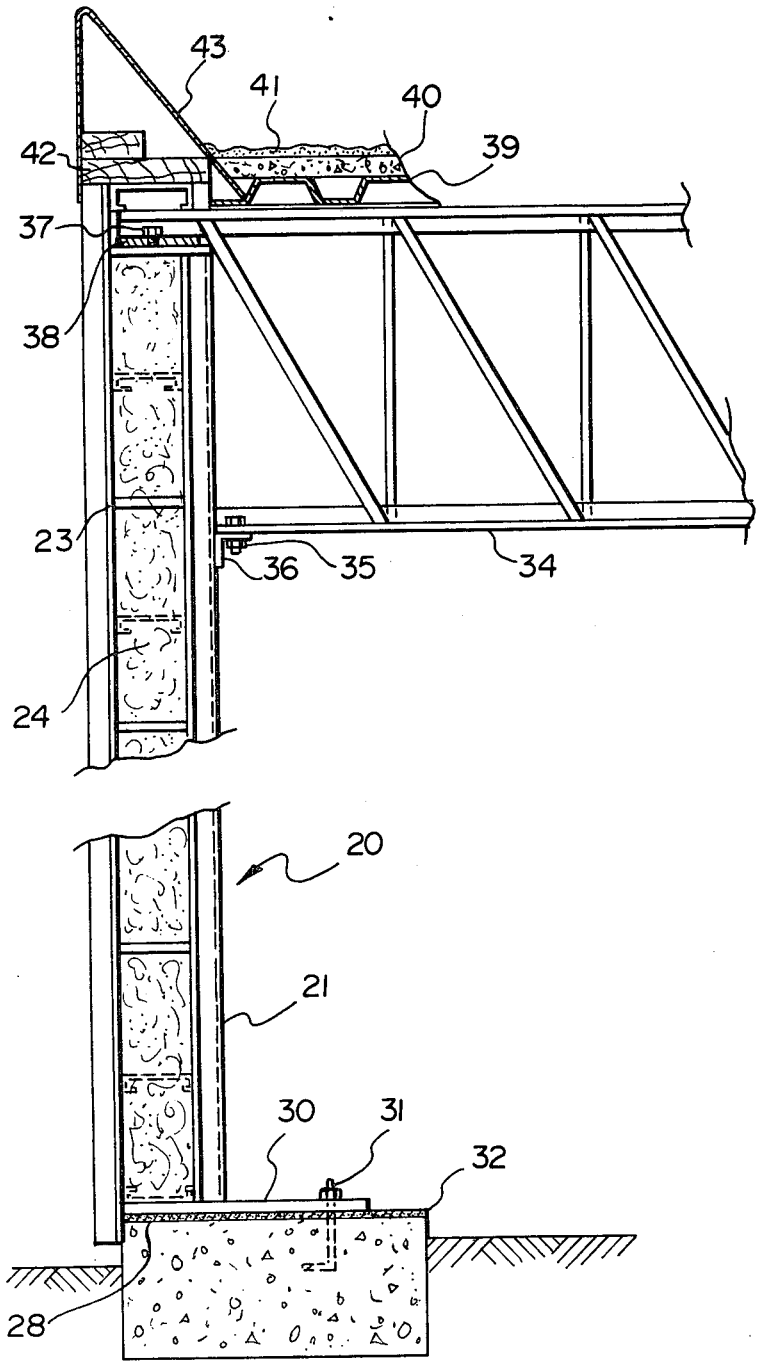
FIG. 3 is a vertical section through a wall of a typical building constructed in accordance with the invention.

FIG. 3 is a vertical section through the wall of a building constructed in accordance with the teachings of the present application. This wall as before is formed of a plurality of similar panel members having interior and exterior 23 enameled steel surfaces with the interior filled with insulation 24. As illustrated in FIG. 3 a plate 30 is fastened to the lower end of the top-hat section 21 and extends interiorly of the building, the plate 30 being provided with an opening through which a bolt 31 may be fastened to secure the panel 20 to the building foundation 32. It will be noticed in FIG. 3 that several important features of the invention are illustrated. For example, the exterior skin 23 extends below the top surface of the building foundation 32 to prevent the ingress of moisture, snow or the like driven against the side of the building during storms. The layer of foam sealant 28 on the lower edge of the panel 21 is compressed against the foundation 32 and forms a weather-proof seal between the foundation and the panel 20.

The panel 20 of FIG. 3 is illustrated supporting a roof truss 34 of conventional construction. The roof truss is fastened to the hat-shaped column sections of the panel 20 by bolting at 35 to an angle bracket 36 welded to the face of the hat-shaped section 21. A further bolt 37 connects the end shoe of the truss 34 to a plate 38 fastened to the top ends of the hat-shaped column members 21. Surmounting the roof truss 34 is a roof deck 39 of the well-known metallic sort, which is normally fastened to the trusses by welding or the like, and positioned on top of the deck 39 is insulation 40 surmounted by a weather-proof roof surface 41. Fastened to the upper end of the wall panel 20 is a wooden sill 42 which provides a nailing surface for the roof copying 43 which is incorporated into the overall roof of the building providing both a finished appearance to the upper edge of the building, and a weather-proof connection between the roof and the exterior surface wall of the building.

Figure 4:
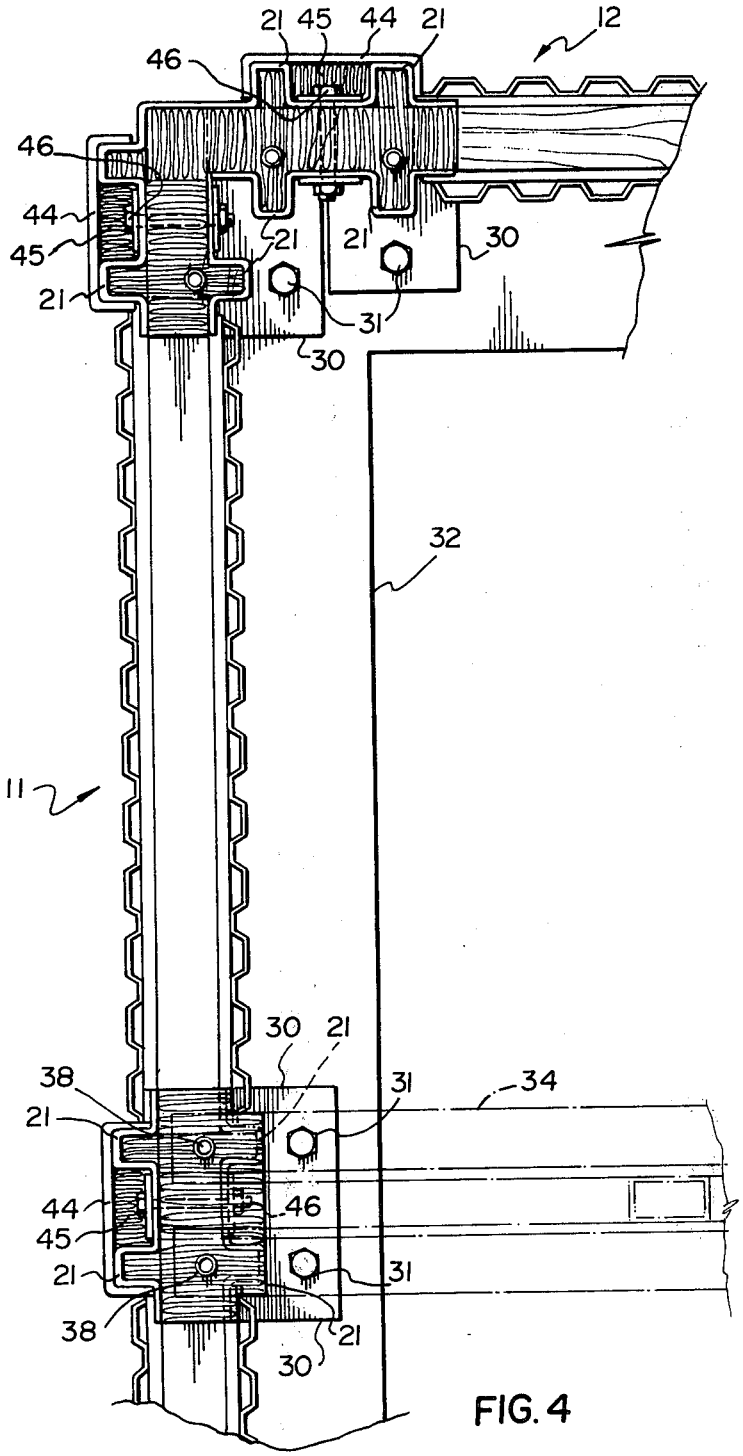
FIG. 4 is a top-plan view of a segment of a building illustrating load bearing and non-load bearing walls joined by a corner, and showing the attachment of a roof truss to the column portion of adjacent panels.

Referring to FIG. 4 there is shown in plan view a corner of a building constructed in accordance with the present invention consisting of a load bearing wall 11, a non-load bearing wall 12, foundation 32 and roof truss 34. As clearly shown in FIG. 4 the plates 30 extend interiorly of the building 10 and are connected to the foundation 32 by bolts 31. The top ends of top-hat sections 21 forming the vertical columns are clearly shown, and it may be seen that each panel is provided with four of these top-hat sections with pairs of top-hat sections of adjacent panels being connected to form the load bearing columns of the building construction. The exterior surfaces of adjacent top-hat sections are covered by a suitable channel shaped member 44, with the space 45 between adjacent hat sections being filled with an appropriate insulation layer. The space between top-hat members on the same end of each panel is of course also filled with an appropriate insulation such as fiberglass.

It will be appreciated that by slotting the openings of the plates 30 through which the bolts 31 extend, that the panels of the invention may be readily aligned after they have been placed on the foundation to true the walls of the finished building. The upper ends of the panels are aligned during erection by the insertion of a single bolt 46 which is passed through the space between adjacent top-hat sections of adjacent panels and on being tightened serves to line the upper edge of the panels thus permitting the entire alignment of the walls of the building without requiring extensive use of heavy lifting equipment.

It should be noted that one of the features of the present invention is that the panels are extremely lightweight. After having been set on the foundation they may readily be aligned by workmen using hand tools, thus enabling a building to be very speedily placed on its foundation and erected in a minimum of time. Such a feature is significantly important in the cost of constructing of the building, and in the necessity for having the building closed in as quickly as possible especially during inclement weather.

Figure 6:
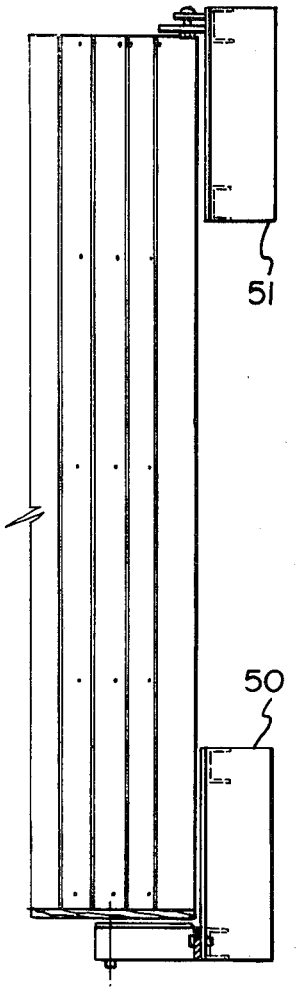
FIG. 6 is a side elevation of the jigs of FIG. 5.
Figure 5:
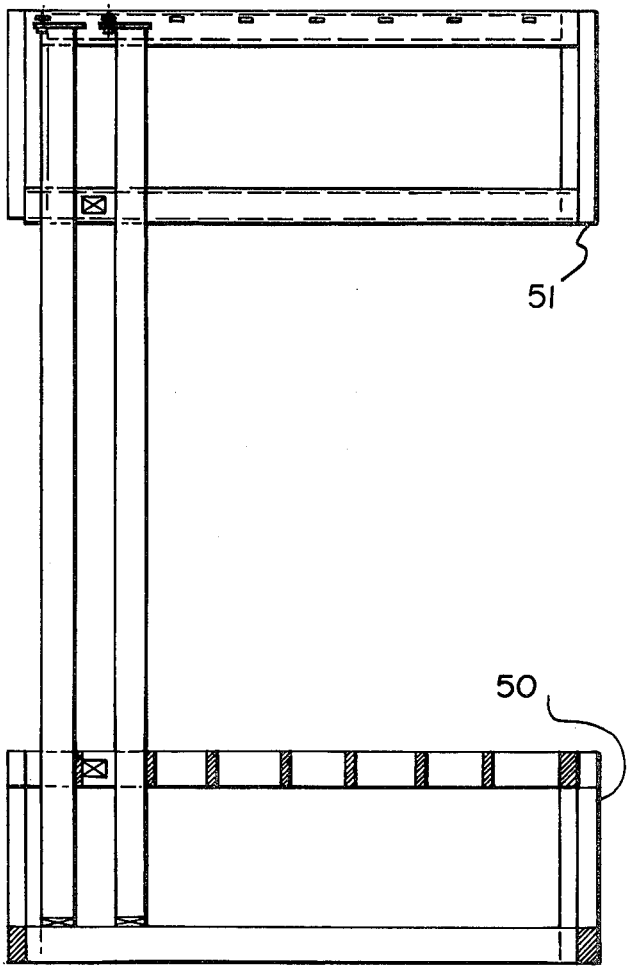
FIG. 5 is a plan view of a pair of jigs used for transporting panels.

A pair of jigs 50 and 51 for transporting panels of the present invention are shown in FIGS. 5 and 6. The two jigs 50 and 51 are similar, but as clearly shown in FIG. 6, slightly different brackets are provided on each end to which the panels are bolted. As illustrated, the jigs 50 and 51 are designed to carry eight panels at a time. Thus the panels secured to the jigs may be carried, for example by semi trailer, to the construction site, unbolted from the jigs and set in place on the foundation, using a light crane.

We claim:

1. A structural building panel comprising interior and exterior skins, the vertical edges of which are connected to pairs of hat shaped cross section vertical members, said vertical members being arranged with the channel portions of the sections facing each other and spaced apart by horizontal girts between said skins joined to the hat shaped vertical members, the space between said skins being filled with insulation.

2. The panel as claimed in claim 1 wherein said insulation comprises at least in part a foamed in place synthetic insulation.

3. The panel as claimed in claim 1 and further comprising plates fastened to the lower end of the interior hat shaped sections, to provide a flange to be joined to the building foundation.

4. The panel as claimed in claim 3 and further comprising a strip of compressible foam fastened to the lower edge of said panel to seal the joint between said panel and a foundation on which it is mounted.

5. The panel of claim 1 including means on the upper end of the interior top hat sections of each panel to support a horizontal joist or truss.

6. The panel of claim 1 joined to a like panel whereby the top hat sections of the two adjacent panels from a hollow load bearing column.

7. The structure as claimed in claim 6 wherein said hollow column is filled with insulation and the channel shaped part of the two exterior channels are covered by a cap extending over and fastened to said channel shaped portions.

* * * * *